US005226412A

United States Patent [19]

Winters

[11] Patent Number: 5,226,412

[45] Date of Patent: Jul. 13, 1993

[54] EMERGENCY RESPIRATOR

[76] Inventor: Alva B. Winters, 800 Nappa Valley Rd., #358, Little Rock, Ark. 72211

[21] Appl. No.: 921,571

[22] Filed: Jul. 30, 1992

[51] Int. Cl.[5] ..... A62B 7/10

[52] U.S. Cl. ..... 128/206.12; 128/205.29; 128/206.21

[58] Field of Search ..... 128/200.24, 201.26, 128/205.29, 206.12, 206.16, 206.17, 206.21

[56] References Cited

U.S. PATENT DOCUMENTS

| | | | |
|---|---|---|---|
| 2,791,216 | 5/1957 | Churchill | 128/206.17 |
| 4,207,882 | 6/1980 | Lamere | 128/206.15 |
| 4,573,464 | 3/1986 | Yo | 128/206.15 |
| 4,614,186 | 9/1986 | John | 128/201.25 |
| 4,793,342 | 12/1988 | Haber | 128/202.27 |

FOREIGN PATENT DOCUMENTS

| | | | |
|---|---|---|---|
| 864828 | 2/1941 | France | 128/206.17 |
| 865696 | 3/1941 | France | 128/206.17 |
| 2322617 | 5/1977 | France | 128/206.17 |

*Primary Examiner*—Edgar S. Burr
*Assistant Examiner*—Eric P. Raciti
*Attorney, Agent, or Firm*—Stephen D. Carver; J. L. Mahurin

[57] ABSTRACT

An Emergency Respirator of a half mask type for in-home or institutional use including a filtration canister housing two carbon elements and two fiberglass elements. The canister is preferably constructed of stamped sheet aluminum or plastic held together by a split U-shaped retaining ring or snap fit clips cast into the casings. A cover forming a plenum is also fixed in place by the retaining ring or snap fit clips. The cover has a bushing for connecting a mouth cover to the respirator. The mouth cover is of an elliptical shape with a central opening to receive the bushing. Valve covers are disposed over webbed openings in the inner casing and the cover to secure rubber diaphragm valves. Each valve allows air flow in a single direction. The inner casing valve allows air from the filter system to pass into the plenum. Air is expelled through the cover's outer valve.

16 Claims, 4 Drawing Sheets

EMERGENCY RESPIRATOR

BACKGROUND OF THE INVENTION

The present invention broadly relates to gas masks or respirators. More particularly, my present invention relates to Emergency Respirator devices. The field of the invention includes art classified in U.S. Class 128, subclass 202.27 or 206.17.

The prior art is replete with gas and smoke masks. Some are intended for military purposes while others are intended for more conventional uses.

Muntz U.S. Pat. No. 703,984 issued Jul. 1, 1902, discloses a respirator. This device includes a hood and a box type respirator with a mouth piece secured to the hood. Schwart U.S. Pat. No. 1,320,935 discloses a gas mask apparently intended for military use. This mask covers the entire face and has a canister attached below the mouth and nose area. Wood U.S. Pat. No. 2,665,286 issued Jan. 12, 1954, discloses a transparent face mask that has a filtering canister disposed in its base. The mask is strapped onto the head by a series of three straps. U.S. Pat. No. 3,202,150 issued to Miller Aug. 24, 1965, discloses a filter attachment for use with a conventional firefighter smoke mask. Bickford U.S. Pat. No. 3,565,068 discloses a self contained emergency breathing apparatus that employs an oxygen generator hook to a hood by a hose. Furthermore, this invention employs a rebreathing system disposed within the hood. U.S. Pat. No. 4,098,270 issued to Dolbe Jul. 4, 1978, discloses a smoke mask with a transparent face shield and an isolated air tight filtration system disposed over the mouth. Tanka U.S. Pat. No. 4,498,472 discloses a smoke mask that covers the mouth and nose, having an attached, pleated bellows. Melbe U.S. Pat. No. 4,565,196 issued Jan. 21, 1986, discloses a disposable smoke mask and apparatus. This patent speaks to a canister containing gas under pressure intended to be hooked to a mask by a hose.

U.S. Pat. No. 4,848,334 issued to Bellm Jul. 18, 1989, discloses a mask for allowing application of gases through the nose and mouth. This is a ventilated nose and mouth mask having a plastic non-elastic adjustable strap.

Michael U.S. Pat. No. 4,934,361 issued June 19, 1990, discloses a respirator of a half mask type with chemical and mechanical cartridges for use therewith. Furthermore, it discloses a lock and seal structure for the housings of the respirator.

Most pertinent to the present disclosure is Haber U.S. Pat. No. 4,793,342 issued Dec. 27, 1988. Haber discloses a mask-hood system for supplying a person with clean air or oxygen during an emergency. It is primarily intended for use by airline passengers and employs a valve system to be hooked to an oxygen source. However, the mask may be removed from the oxygen supply leaving the user with a charcoal cartridge filter system. This portion is intended to be used by the passenger during an attempt to escape a smoke filled aircraft.

The prior art discloses a plethora of masks suitable for use by professionals or during an emergency in a controlled environment such as an airliner. But, an inexpensive respirator for in-home or institutional use is unavailable. Today's safety conscience home employs devices such as smoke detectors, burglar alarms, and medical alert systems. An Emergency Respirator that could easily be stored would find a place in these homes. For example, a respirator for each occupant could be stored in the appropriate bedroom, ready for immediate use during a fire.

Institutions, such as nursing homes, are often under staffed and constructed in such a manner that residents must traverse a great length of hallway to exit. These two factors prove for disaster during a fire. The few staff members available must escort elderly and physically impaired resident down lengthy smoke filled hallways. If convenient inhalation respirators were available the more mobile residents could take advantage of them to exit thereby freeing the staff to aid those less mobile.

However, the budgetary constraints as well as the space constraints imposed on the typical nursing home would necessarily prevent the institution from purchasing conventional gas masks for each resident. Yet, most would find a way to acquire lowcost respirators.

Such a device would necessarily be small and unobtrusive as well as being relatively inexpensive and of a somewhat disposable nature. Importantly, suitable respirators should be user serviceable, and should readily facilitate user maintenance and filter replacement. Primarily such a device must be quickly deployable and easy to use. While such a respirator may not be elaborate, dependability and straightforward structure would be its hallmark.

SUMMARY OF THE INVENTION

The present inventor has developed an inexpensive Emergency Respirator for in-home or institutional use. The respirator can be stored in a suitable location such as the bedroom, and is ready for immediate use during a fire. It is small and relatively inexpensive as it is of a somewhat disposable nature. More importantly, it is quick and easy to use while being very dependable.

The Emergency Respirator is primarily comprised of a filtration canister, a plenum formed by a cover secured to the canister and a mouthpiece affixed to the cover. A strap is also affixed to the cover. Two valves, an inner valve and an outer valve, control the flow of air through the respirator. All the parts may be quickly disassembled by the user for maintenance.

The filtration canister houses two treated carbon elements and treated fiberglass elements between and on either side of the carbon elements. The canister is preferably constructed of stamped sheet aluminum or plastic. The metal canister is made of two casings held together by a split U-shaped retaining ring. The plastic canister is held together by snap fit clips cast into the casings. The cover forming the plenum is also fixed in place by the retaining ring or snap fit clips.

The outer casing has a large opening to permit ambient air into the filtration system. The outer casing has eight small triangular shaped orifices in the end opposite the large opening. The orifices are arranged around a generally circular central locus forming a more or less circular, webbed opening. The cover also has a series of triangular orifices defining a webbed, circular opening with a circular central locus. The metal cover also has a single round orifice for connecting the mouthpiece to the respirator using a tubular bushing. The plastic cover has a bushing cast into it to allow a mouth cover to be directly attached to the cover. The mouth cover has an elliptic shape with a central opening to receive the bushing.

Valve covers are disposed over the webbed openings in the inner casing and the cover. They secure a rubber diaphragm type valve and over the webbed openings. Each valve allows air flow in a single direction. The inner casing valve allows air from the filter system to pass into the plenum. Air is expelled through the cover's outer valve.

Therefore a primary object of the present invention is to provide an Emergency Respirator that is well adapted for home use.

A related primary object of the present invention is to provide an Emergency Respirator convenient for use by presidents of institutions such as nursing home or hospitals.

A related object of the present invention is to provide an Emergency Respirator that is inexpensive and easily serviced.

A further object of the present invention is to provide an Emergency Respirator that is small, compact, and unobtrusive.

A further fundamental object of the present invention is to provide an Emergency Respirator that is straight forward in design and function.

A related object of the present invention is to provide an Emergency Respirator that has a minimum of moving parts.

Finally, an object of the present invention is to provide an Emergency Respirator that is easy to deploy and use.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and in which like reference numerals have been employed throughout to indicate like parts in the various views.

DETAILED DESCRIPTION

Figure 7:
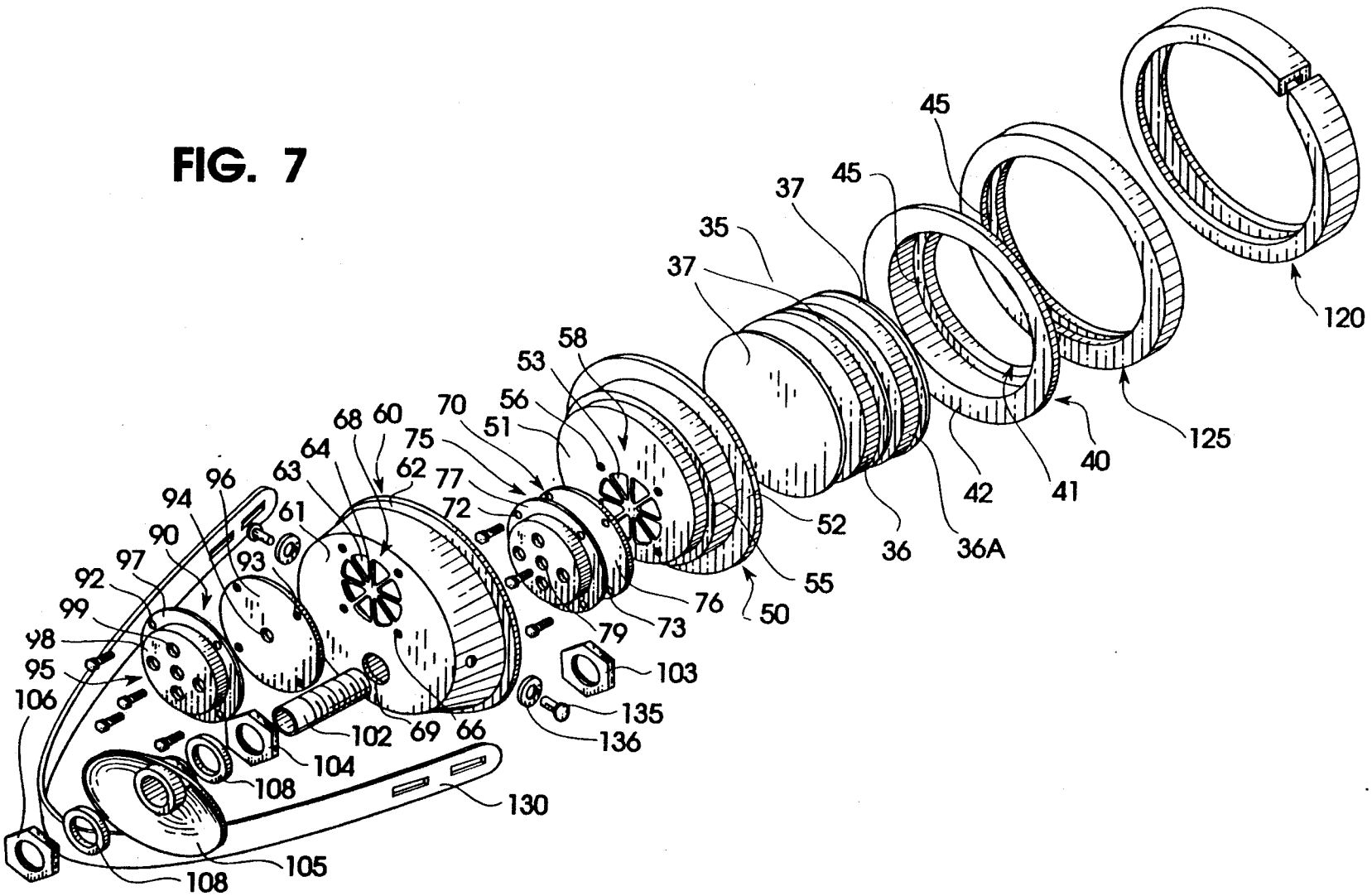
FIG. 7 is an enlarged, fragmentary exploded isometric assembly view.

Turning now to the drawings the best mode of the herein disclosed emergency respirator is broadly designated by the reference numeral 20. It is primarily comprised of a filtration canister 30 to which a cover 60 is affixed forming a plenum 80 and a mouthpiece 100 affixed to the cover 60. A strap 130 is affixed to the cover 60 to facilitate use of the respirator. Further as illustrated in the cross-section views of FIGS. 5 and 7 an inner valve 70 is disposed on the filtration canister 30 and an outer valve 90 is disposed on the cover 60.

The filtration canister 30 houses a filter system 35. The filter system 35 comprises two disk shaped carbon elements 36 and 36A with a fiberglass element 37 disposed on either side of the carbon elements and between them. This arrangement of fiberglass elements 37 prevents the carbon from being directly exposed to the ambient air 200 or the filtered air 250. The carbon elements 36 and 36A are made of different source material such as conventional wood charcoal and coconut shell charcoal. The carbon elements and fiberglass filters 37 are also chemically treated to nullify toxic fumes that pass through them. These components are of a conventional nature such as Activated Carbon Filters Type PCB or ASC that may be purchased from Calgon Corporation. The fiberglass filters are available from Hollingsworth & Vose Company of East Walpole, Mass. as Type H-60FG or H-95F.

Figure 5:
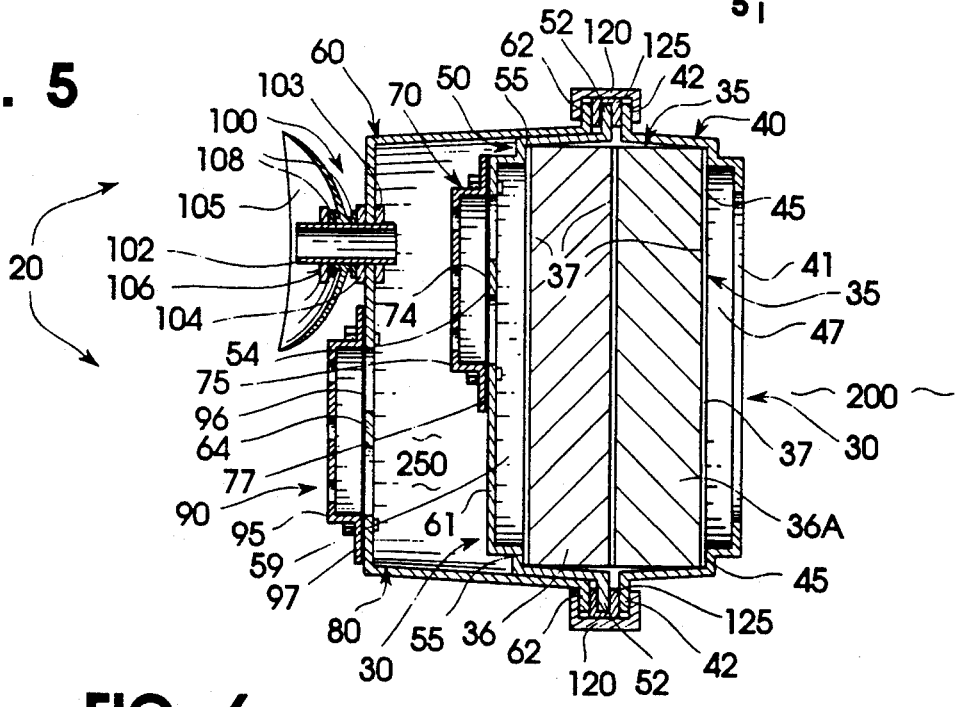
FIG. 5 is a fragmentary sectional view taken generally along line 4—4 of FIG. 3.

The canister 30 is preferably constructed of stamped sheet aluminum. The canister 30 comprises two casings 40 and 50 (FIG. 5). A tubular outer casing 40 defines a large circular opening 41 for the intake of ambient air 200. It terminates at its opposite end in a circular flange 42. This flange 42 mates with a flange 52 on an inner casing 50. The inner casing 50 is of shape similar to the outer casing 40 but defines a series of small triangular shaped orifices 53 in the end 51 flange 52. There are eight of these triangular shaped orifices 53 arranged around a generally circular central locus 54 forming a generally circular opening 58 spanned by a web. Four threaded bolt holes 56 are equally spaced about this webbed opening 58. Each casing has a shoulder 45 and 55. When the casings 40 and 50 are joined these shoulders define an inner volume 32 that confines the filter system 35. Hence, the filter system 35 is spaced apart from the ends of the casings 40 and 50 forming air gaps 49 and 59.

As mentioned above a plenum 80 is defined between the cover 60 and the filtration canister 30. The cover 60 is also primarily formed of stamped sheet aluminum and of a tubular shape. However, its interior has a diameter slightly larger than the diameter of the exterior of the filtration canister 30. Like the aforementioned casings 40 and 50 the cover 60 has a flange 62 disposed on one end. As with the inner casing 50 a series of triangular orifices 63 defining a webbed, circular opening 68 with a circular central locus 64 and four threaded bolt holes 66 disposed evenly around the opening 68 is defined in the other end 61. Additionally, a single circular orifice 69 somewhat smaller than the webbed circular opening 68 is disposed in the same end 61. The orifice 69 is spaced apart but aligned with the webbed opening 68.

The mouthpiece 100 is intended to allow the user 10 of the respirator to breathe filtered air 250 through his mouth. The mouthpiece 100 has a standard pipe nipple or bushing 102 secured through the smaller orifice 69 in the cover 60 by a pipe nut 103 and 104 on either side of the cover 60. A pliable rubber mouth cover 105 is secured between the outer pipe nut 104 and a third nut 106. Flat washers 108 are disposed on either side of the mouth cover 105 between the nuts 104, 106 and the mouth cover 105. The mouth cover 105 is formed of medium-hard rubber. It is of a generally elliptical shape with a central opening intended to be disposed upon the pipe bushing 102.

Valve covers 75 and 95 are disposed over the webbed openings 58 and 68 defined in the end of the inner casing 50 and the cover 60 respectively. These valve covers 75 and 95 secure a rubber diaphragm type valve 76 and 96 over the webbed openings 58 and 68. Each of these valves 76 and 96 will allow the air to pass from the side opposite the valve cover 75 or 95 to the side with the valve cover 75 or 95. The valve covers 75 and 95 are circular each having a flange 77 or 97 extending upward to a face 78 or 98 defining a central orifice 79 or 99 and four orifices 79 or 99 equally spaced about the central orifice 79 or 99. The flange 77 or 97 has four bolt holes 72 or 92 corresponding to the threaded bolt holes 66 or 56 in the cover 60 and the inner casing 50 respectively.

The first, inner valve 70 allows the air to pass from the filter system 35 into the plenum 80. This air is drawn by the respiration action of the user 10. Air is expelled through the second, outer valve 90. Neither valve 70 or 90 will allow 200 or 250 to pass in the opposite direction. This is accomplished by a diaphragm valve 76 or 96 formed of a flat piece of rubber. This rubber is of a circular shape and has holes 73 or 93 disposed about its outer edge corresponding to the bolt holes in the valve covers, casing and cover 60. The rubber valve also has a central orifice 74 or 94 that is smaller than the central locus 54 or 64 of the webbed openings 58 or 68. Therefore the inner valve 70 seals whenever the user 10 breathes into the plenum 80 thereby raising the pressure within the plenum 80. The inner valve 70 releases whenever the user 10 breathes in, thereby lowering the relative pressure in the plenum 80. The outer valve 90 allows air to escape the plenum 80 when the user 10 breathes out thereby raising the relative pressure in the plenum 80. As the user 10 breathes in, lowering the pressure within the plenum 80, the outer diaphragm valve 96 seals against the locus 68 of the webbed opening.

Figure 6:
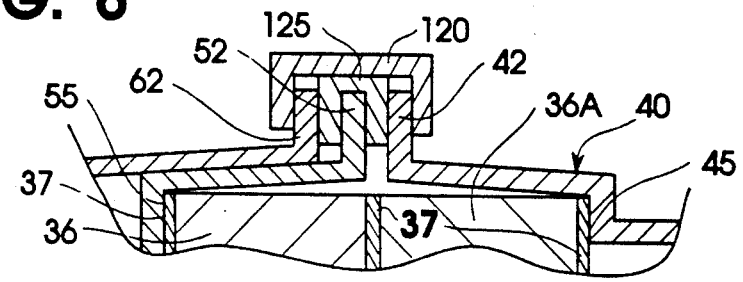
FIG. 6 is an enlarged, fragmentary sectional view of a portion of FIG. 5 illustrating the spatial relationship of the flanges, gasket and retaining ring.

A resilient, split retaining ring 120 joins and yieldably, sealing locks the cover 60 to the filtration canister 30. The retaining ring has a "U" shaped cross-section (FIG. 6) It captures the flanges 42 and 52 of the two canister casings 40 and 50 and flange 62 of the cover 60. A "U" shaped gasket 125 is disposed over the inner casing flange 52 to facilitate sealing the respirator from ambient air 200. This gasket 125 extends from between the two filtration casing flanges 42 and 52 over the inner casing flange 52 to between the inner casing flange 52 and the cover flange 62 (FIG. 6). Therefore, the filter system 35 only receives ambient air 200 through the circular opening 41 defined in the end of the outer casing 40. Conversely the plenum 80 allows air to only pass into it from the filter system 35 or from the user's mouth.

An elastic strap 130 is secured to the cover 60 by a pair on through rivets 135 upon each of which a washer 136 is disposed to facilitate sealing.

Figure 8:
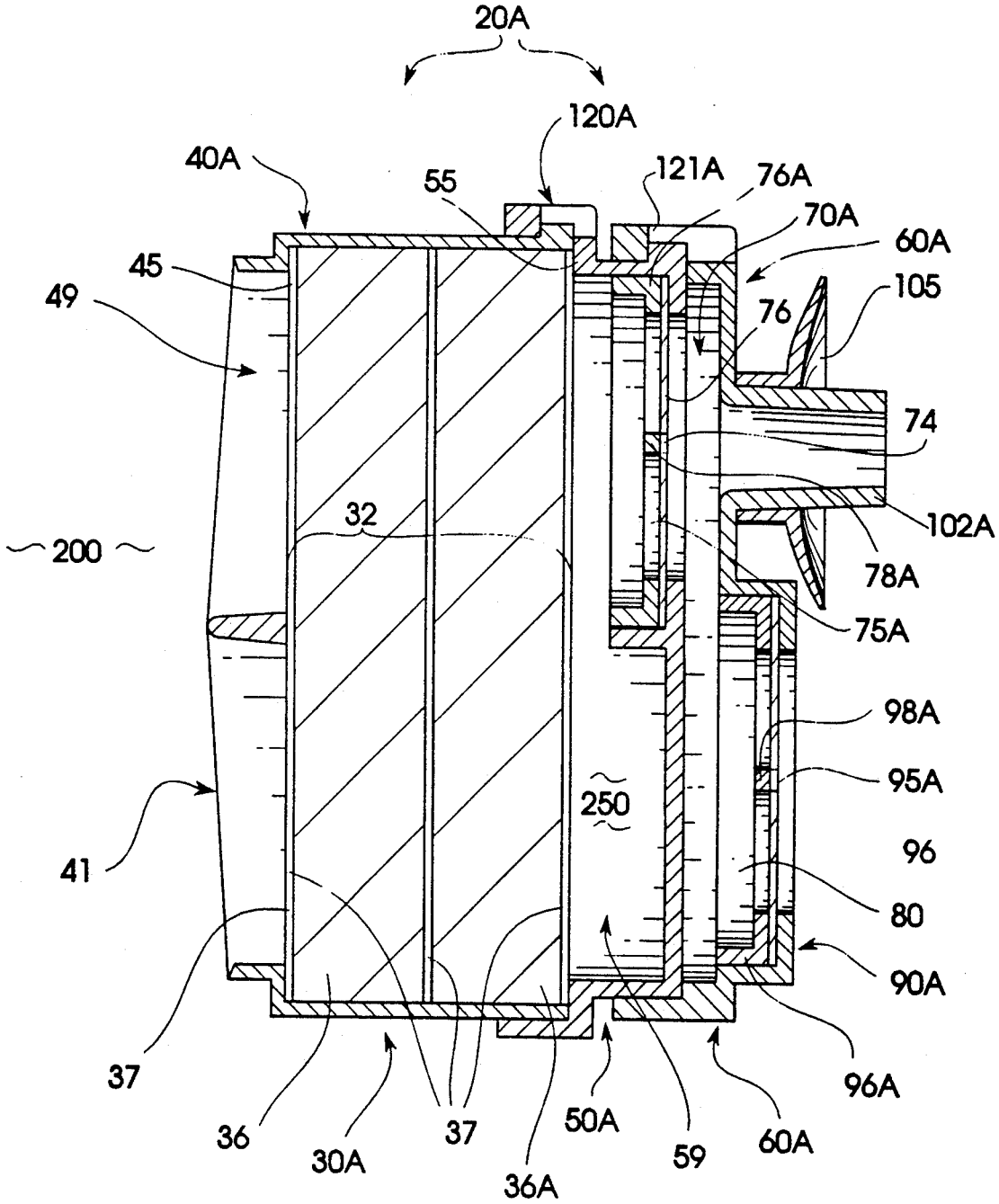
FIG. 8 is a fragmentary longitudinal sectional view of an alternative embodiment.

An alternative embodiment 20A (FIG. 8) employs ejection molded plastic components that are designated in the text below and in FIG. 8 by the same reference numerals as above and where they differ by the same reference numerals with an "A" suffix. In the place of the "U" shaped, split retaining ring 120 the unit is held together by snap-fit clips 120A. These snap-fit clips 120A are disposed radially around the filter canister casings 40A and 50A in the place of the previously disclosed flanges 42 and 52. Additionally, the cover 60A employs similar snap-fit clips 121A to secure it to the inner casing 50A of the filtration canister 30A. The alternative embodiment also employs valve covers 70A and 90A that are cast into the cover 60A and the inner casing 50A. Circular rubber diaphragm valves 76 and 96 are held in place by internal inserts 76A and 96A that have webs 75A and 95A traversing the opening for the valves. The webs provide central loci 78A and 98A. The final significant difference in the alternative embodiment is that the mouthpiece bushing 102A is cast into the cover 60A. The mouth cover 105 as described above is slipped over the cast-in bushing 102A.

Figure 1:
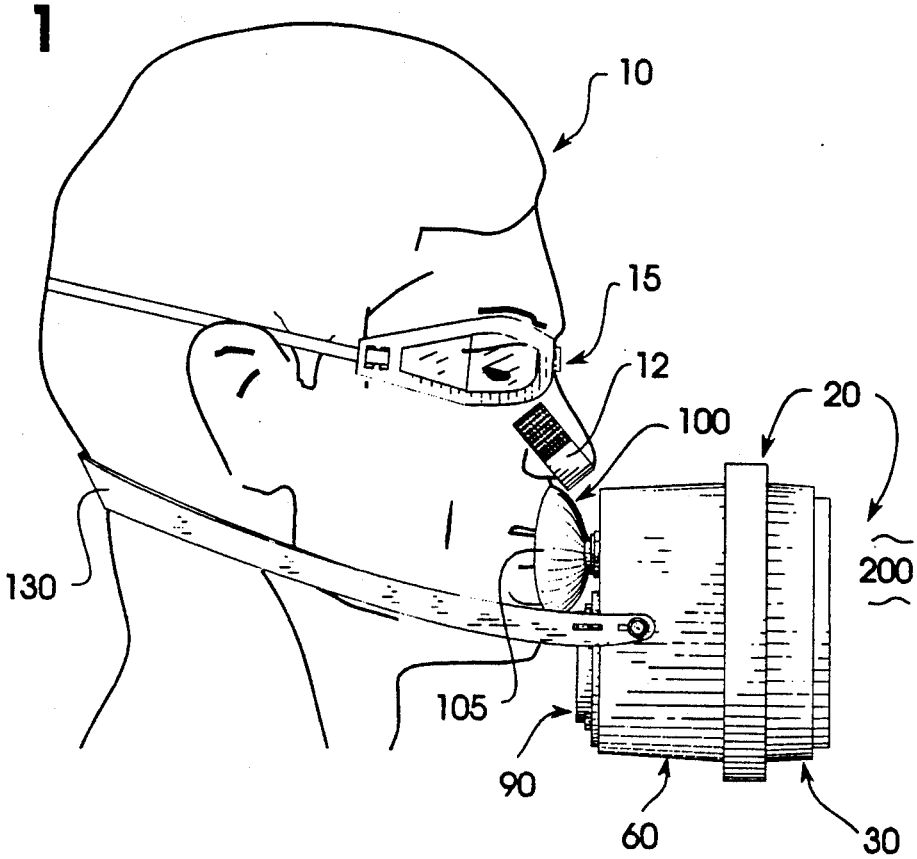
FIG. 1 is a fragmentary, perspective environmental view showing the preferred embodiment of the herein disclosed Emergency Respirator in use.
Figure 2:
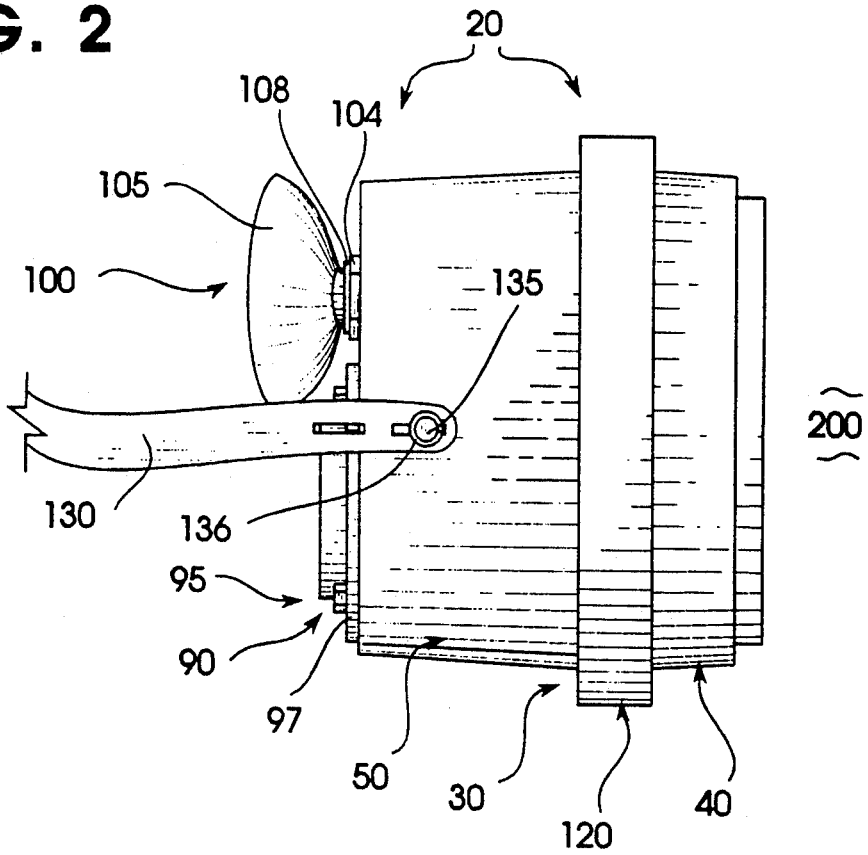
FIG. 2 is a side elevational view thereof.
Figure 3:
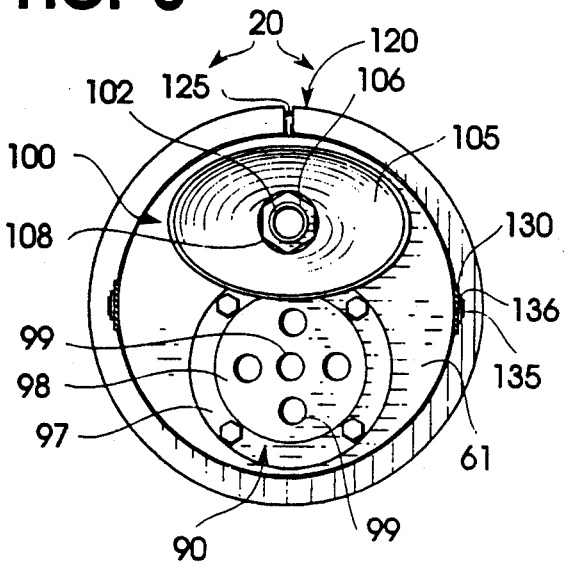
FIG. 3 is a rear plan view thereof.
Figure 4:
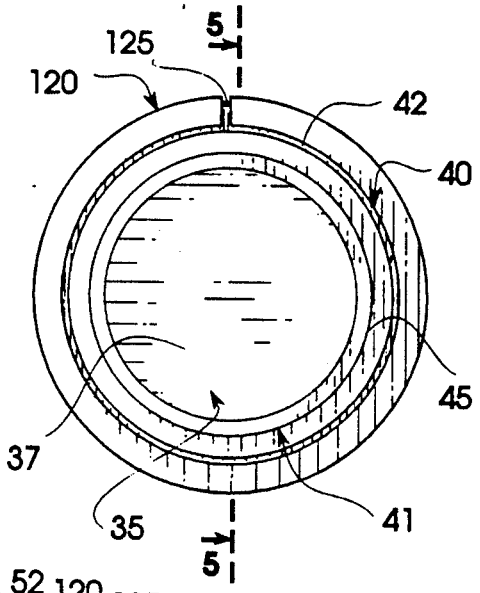
FIG. 4 is a front plan view of the respirator.

The above disclosed respirator 20 is employed in an emergency situation. The mouth cover 105 is disposed over the user's mouth and the strap 130 can be pulled over the user's head to secure the respirator 20 in place. The user 10 breathes in and out through his mouth. As illustrated in FIG. 1 an adhesive strip bandage 12 can be employed to cover the nostrils of the user 10 to facilitate breathing only through the mouth. Further, goggles 15 may be employed to help keep vision clear while the user 10 moves through smoke filled areas.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A respirator comprising:

a disposable filter located within said respirator;

user serviceable canister means for receiving and confining said filter, said canister means comprising:

an outer generally tubular casing comprising a partially open end and an integral, circumferential flange spaced apart from said open end; and, an inner generally tubular casing for coupling to said outer casing, wherein an inner volume is defined between said inner and outer casings and said filter is received within said inner volume, said inner casing comprising an integral circumferential flange mated with said outer casing flange and an air inlet for admitting air into said inner volume;

cover means for defining a plenum adjacent said canister means, said cover means fitted to said canister means, said cover means comprising an elongated, tubular housing having an integral flange coupled to said inner and outer casing flanges;

resilient, removable retaining ring means for sealingly locking said inner and outer casings and said cover means together;

mouthpiece means in fluid flow communication with said plenum for enabling a user to breathe through said respirator;

first valve means for unidirectionally allowing the flow of air from said inner volume into said plenum when a user inhales through said mouthpiece means; and, second valve means for unidirectionally exhausting air from said plenum externally of said respirator when said user exhales through said mouthpiece means.

2. The respirator as defined in claim 1 wherein said mouthpiece means is secured to said cover means and spaced apart from said canister means.

3. The respirator as defined in claim 2 wherein said second valve means is disposed in said cover means.

4. The respirator as defined in claim 1 wherein said cover means comprises a closed end having a plurality of orifices to establish fluid flow communication to said second valve means and an orifice in fluid flow communication with said mouthpiece means.

5. The respirator as defined in claim 4 wherein said retaining ring means comprises a generally U-shaped cross section for compressively confining said flanges together to maintain said inner and outer casings and said cover means together.

6. The respirator as defined in claim 1 wherein said inner casing comprises an integral offset portion projecting toward said mouthpiece for establishing an air gap adjacent said filter.

7. The respirator as defined in claim 1 wherein said outer casing comprises an integral offset portion projecting outwardly from said respirator for establishing an air gap adjacent said filter.

8. The respirator as defined in claim 1 wherein said first and second valve means each comprises a valve cover comprising:

a generally tubular body portion;

a peripheral mounting flange integral with said body portion;

a plurality of mounting orifices defined in said last mentioned flanges; and, a plurality of air passageways defined in said valve cover(s).

9. The respirator as defined in claim 8 wherein said cover, casings and valve covers are constructed of metal.

10. A respirator comprising:

a disposable filter located within said respirator;

user serviceable canister means for receiving and confining said filter, said canister means comprising:

an outer generally tubular casing comprising a partially open end and an integral, circumferential flange spaced apart from said open end; and, an inner generally tubular casing for coupling to said outer casing, wherein an inner volume is defined between said inner and outer casings and said filter is received within said inner volume, said inner casing comprising an integral circumferential flange mated with said outer casing flange and an air inlet for admitting air into said inner volume;

cover means for defining a plenum adjacent said canister means, said cover means comprising an integral flange coupled to said inner and outer casing flanges;

resilient means for sealingly locking said inner and outer casings and said cover means together;

mouthpiece means in fluid flow communication with said plenum for enabling a user to breathe through said respirator;

first valve means for unidirectionally allowing the flow of air from said inner volume into said plenum when a user inhales through said mouthpiece means; and, second valve means for unidirectionally exhausting air from said plenum externally of said respirator when said user exhales through said mouthpiece means.

11. The respirator as defined in claim 10 wherein said mouthpiece means comprises a bushing passing through and affixed to said cover means and a rubber mouth cover secured around said bushing.

12. The respirator as defined in claim 10 further comprising strap means for flexibly securing said respirator to said user, said strap means secured to said cover means.

13. The respirator as defined in claim 10 wherein said means for sealingly locking said inner and outer casings and said cover means together comprises snap fit tabs disposed about said integral, circumferential flanges.

14. The respirator as defined in claim 13 wherein said mouthpiece means comprises a rubber mouth cover secured in fluid flow communication with said respirator by an bushing extending integrally from said cover.

15. The respirator as defined in claim 14 wherein said cover, casings and valve covers are constructed of plastic.

16. An emergency smoke mask comprising:

a disposable filter located within the smoke mask for filtering air;

user serviceable canister means for receiving and confining said filter, said canister means comprising:

an outer generally tubular casing comprising a partially open end and an integral, circumferential flange spaced apart from said open end; and, an inner generally tubular casing for coupling to said outer casing, wherein an inner volume is defined between said inner and outer casings and said filter is received within said inner volume, said inner casing comprising an integral circumferential flange mated with said outer casing flange and an air inlet for admitting air into said inner volume;

cover means for defining a plenum adjacent said canister means, said cover means fitted to said canister means, said cover means comprising an elongated, tubular housing having an integral flange coupled to said inner and outer casing flanges;

resilient means for sealingly locking said inner and outer casings and said cover means together;

mouthpiece means secured to said cover means in fluid flow communication with said plenum for enabling a user to breathe;

first valve means for unidirectionally allowing the flow of air from said inner volume into said plenum when a user inhales through said mouthpiece means;

second valve means for unidirectionally exhausting air from said plenum externally of said respirator when said user exhales through said mouthpiece means; and, strap means for flexibly securing said mask to said user.

* * * * *